US012460423B2

(12) United States Patent
Wheatley

(10) Patent No.: US 12,460,423 B2
(45) Date of Patent: Nov. 4, 2025

(54) BRACKET FOR INTERCONNECTING THE TERMINAL END OF DECK BOARDS AND RELATED METHODS

(71) Applicant: IMOTAK LLC, Sandy, UT (US)

(72) Inventor: Thomas F. Wheatley, Sandy, UT (US)

(73) Assignee: IMOTAK, LLC, Sandy, UT (US)

( * ) Notice: Subject to any disclaimer, the term of this patent is extended or adjusted under 35 U.S.C. 154(b) by 252 days.

(21) Appl. No.: 18/304,201

(22) Filed: Apr. 20, 2023

(65) Prior Publication Data

US 2024/0352747 A1 Oct. 24, 2024

(51) Int. Cl.

| | |
|---|---|
| ***E04F 13/24*** | (2006.01) |
| ***E04F 15/02*** | (2006.01) |
| *E04B 1/00* | (2006.01) |
| *E04F 13/08* | (2006.01) |

(52) U.S. Cl.

CPC ..... *E04F 15/02044* (2013.01); *E04B 1/003* (2013.01); *E04F 13/0803* (2013.01); *E04F 13/24* (2013.01); *E04F 2015/02066* (2013.01); *E04F 15/02183* (2013.01)

(58) Field of Classification Search

None

See application file for complete search history.

(56) References Cited

U.S. PATENT DOCUMENTS

| | | | | |
|---|---|---|---|---|
| 2,659,323 A | | 11/1953 | Alvarez, Jr. | |
| 3,015,193 A | | 1/1962 | Amoruso | |
| 3,174,256 A | | 3/1965 | Lockwood | |
| 3,237,360 A | | 3/1966 | Mills | |
| 3,261,136 A | | 7/1966 | Abner et al. | |
| 3,568,391 A | | 3/1971 | Conway | |
| 3,619,963 A | * | 11/1971 | Omholt | E04F 15/04 52/480 |
| 4,506,486 A | | 3/1985 | Culpepper, Jr. et al. | |
| 4,925,141 A | | 5/1990 | Classen | |

(Continued)

FOREIGN PATENT DOCUMENTS

| | | | |
|---|---|---|---|
| AT | 506244 | A1 | 7/2009 |
| DE | 102014115257 | A1 | 4/2016 |

(Continued)

OTHER PUBLICATIONS

Photograph of StepClip by Veranda, published at least as early as Mar. 6, 2023.

*Primary Examiner* — Phi D A
*Assistant Examiner* — Phi D Tran
(74) *Attorney, Agent, or Firm* — Workman Nydegger

(57) ABSTRACT

A bracket for interconnecting the terminal ends of boards includes a shelf member having a top face and an opposing bottom face that each extend between a first end and an opposing second end; a mounting plate having a front face and an opposing back face that each extend between an upper end and an opposing lower end, the upper end of the mounting plate projecting outward from the bottom face of the shelf member; a first connector upstanding from the top face of the shelf member at the first end thereof and projecting forward of the front face of the mounting plate; and a second connector upstanding from the top face of the shelf member at the second end thereof and projecting forward of the front face of the mounting plate, the first and second connector each having a T-shaped transverse cross section.

21 Claims, 8 Drawing Sheets

(56) References Cited

U.S. PATENT DOCUMENTS

| | | | | |
|---|---|---|---|---|
| 5,497,593 | A | 3/1996 | Riesberg | |
| 5,501,050 | A | 3/1996 | Ruel | |
| 5,611,179 | A * | 3/1997 | Leek | E04B 1/2608 52/715 |
| 5,997,209 | A * | 12/1999 | Sachs | E04F 15/04 52/480 |
| 6,170,214 | B1 | 1/2001 | Treister et al. | |
| 6,195,952 | B1 | 3/2001 | Culpepper et al. | |
| D450,568 | S | 11/2001 | Sachs | |
| 6,315,489 | B1 | 11/2001 | Watanabe | |
| 6,349,507 | B1 | 2/2002 | Muellerleile | |
| 6,598,362 | B2 | 7/2003 | Hikai | |
| 6,615,560 | B2 | 9/2003 | Hiroshi | |
| 6,637,170 | B2 | 10/2003 | Hiroshi | |
| 6,786,804 | B2 | 9/2004 | Watanabe | |
| 6,830,405 | B2 | 12/2004 | Watanabe | |
| D530,833 | S | 10/2006 | Robertson et al. | |
| D573,454 | S | 7/2008 | Egerle, III | |
| 7,665,260 | B2 | 2/2010 | Hikai | |
| D617,011 | S | 6/2010 | Guffey | |
| 7,805,902 | B2 * | 10/2010 | Martel | E04F 15/10 52/489.1 |
| 7,849,651 | B2 | 12/2010 | Fujito et al. | |
| 8,146,303 | B2 * | 4/2012 | Gibson | E04B 5/12 52/489.1 |
| 8,544,229 | B2 * | 10/2013 | Kilgore | E04F 15/04 D8/382 |
| 9,181,716 | B1 * | 11/2015 | Gibson | E04B 1/38 |
| 9,308,432 | B1 | 4/2016 | Olson | |
| 9,416,546 | B2 * | 8/2016 | Claudin | E04B 5/02 |
| 9,422,728 | B2 | 8/2016 | Gamble et al. | |
| 9,637,934 | B2 | 5/2017 | Wadsworth | |
| 9,976,312 | B2 | 5/2018 | Boschian | |
| D839,723 | S | 2/2019 | Bowker | |
| 10,738,462 | B2 | 8/2020 | Bowker | |
| 10,895,080 | B1 * | 1/2021 | MacKenzie | E04F 15/02044 |
| 11,098,489 | B1 * | 8/2021 | Wheatley, III | E04F 15/02044 |
| 2002/0023398 | A1 | 2/2002 | Hiroshi | |
| 2002/0046536 | A1 | 4/2002 | Hotta | |
| 2003/0154662 | A1 | 8/2003 | Bruchu et al. | |
| 2004/0111993 | A1 | 6/2004 | Hollman | |
| 2006/0059822 | A1 | 3/2006 | Guffey | |
| 2006/0265988 | A1 | 11/2006 | Fujito et al. | |
| 2008/0216430 | A1 | 9/2008 | Gleeson et al. | |
| 2009/0217495 | A1 | 9/2009 | Tipps et al. | |
| 2009/0249721 | A1 | 10/2009 | Cullen | |
| 2010/0146900 | A1 * | 6/2010 | Holland | E04F 15/02 52/715 |
| 2012/0117901 | A1 | 5/2012 | Loyd | |
| 2013/0014465 | A1 | 1/2013 | Kilgore | |
| 2013/0025230 | A1 | 1/2013 | Turner | |
| 2014/0366334 | A1 | 12/2014 | Gamble et al. | |
| 2015/0275951 | A1 | 10/2015 | Shadwell et al. | |
| 2017/0051515 | A1 | 2/2017 | Aquilani | |
| 2017/0314278 | A1 * | 11/2017 | Lee | E04B 1/388 |
| 2017/0362815 | A1 | 12/2017 | Brigham | |
| 2019/0284796 | A1 | 9/2019 | Bowker | |
| 2021/0131121 | A1 | 5/2021 | MacKenzie | |
| 2021/0164235 | A1 * | 6/2021 | Schneider | E04F 13/0803 |

FOREIGN PATENT DOCUMENTS

| | | |
|---|---|---|
| JP | 60158814 A | 6/1994 |
| KR | 1020210022595 | 3/2021 |

* cited by examiner

BRACKET FOR INTERCONNECTING THE TERMINAL END OF DECK BOARDS AND RELATED METHODS

CROSS-REFERENCE TO RELATED APPLICATIONS

Not applicable.

BACKGROUND OF THE INVENTION

1. The Field of the Invention

The present invention relates to hidden brackets for connecting the ends of deck flooring boards, and particularly composite deck flooring boards, to an underlying floor joist without using nails or screws directly on the flooring boards.

2. The Relevant Technology

Deck flooring boards are typically affixed to underlying floor joists by passing nails or screws through the top surface of the flooring boards and into the underlying floor joists. Over time, however, such fasteners tend to work out, resulting in loose boards and an uneven deck surface. In addition, passing the fasteners down through the top surface of the flooring boards can damage the boards and produce unsightly and irregular markings on the exposed top surface which can be aesthetically distracting and unpleasing.

Properly securing the ends of flooring boards to underlying joists is especially problematic. For example, depicted in FIG. 1 is a top view of a partially assembled flooring assembly 10 that includes spaced apart floor joists 12A, 12B, 12C, 12D, and 12E disposed in parallel alignment and having flooring boards 14A, 14B, and 14C spanning across the floor joists 12 in perpendicular alignment thereto. When forming a deck, it is common for the deck to have a size that is larger than the length of conventional flooring boards. Such decks are typically formed by placing and securing flooring boards end to end. At the locations where two flooring boards are being secured end to end, two floor joists are commonly placed side to side. Specifically, as shown in FIG. 1, floor joists 12C and 12D are placed side to side directly adjacent to each other. Flooring board 14A has an end 16A that is disposed on top of floor joist 12C while flooring board 14B has an end 16B that is disposed on top of floor joist 12D directly adjacent to end 16A. Ends 16A and 16B are again typically secured to floor joists 12C and 12D, respectively, by passing screws or nails down through ends 16A and 16B and into floor joists 12C and 12D. Floor joists 12C and 12D are thus necessary to ensure that both ends 16A and 16B are properly supported and properly secured so as to prevent unwanted bending, twisting, flexing, lifting or other movement of ends 16A and 16B.

Although the configuration shown in FIG. 1 is useful in securing flooring boards end to end on a deck, it has several shortcomings. For example, flooring joists are expensive to purchase and are expensive and time consuming to install. Furthermore, the locations of where flooring boards are secured end to end are typically staggered at different locations so as avoid the formation of a single continuous seam, which can be unsightly or potentially a building code violation. As such, it is often necessary to place dual joists side by side at a number of different locations on the deck, thereby further increasing the cost, time, and labor for assembly. In addition, passing fasteners down through the end of flooring boards can be problematic because there is less supporting material encircling the fasteners. As such, insertion of fasteners through the end of the flooring boards can result in damage to the flooring boards, such as by splitting the boards. In addition, expansion and contraction of the flooring boards, due to changes in environmental temperature, can magnify failure or loosening of the flooring boards at the ends.

More recently, conventional wood flooring boards have been replaced with composite flooring boards. Composite flooring boards can be produced from a blend of wood and plastic particles that are formed into a board shape. They are a particularly attractive choice for outside deck flooring boards because they are substantially rot-resistant but yet can be formed having a uniform appearance that is substantially free of defects. The composite flooring boards can also be cut and fastened using the same techniques as conventional wood flooring boards. For example, composite flooring boards are typically secured to underlying floor joists by passing fasteners down through the composite flooring boards and into the floor joists.

In one approach to solve the above discussed problems with placing fasteners down through the top surface of composite flooring boards, composite boards have been formed having a recessed slot along each side of the board. During assembly, special clips are secured directly to the floor joists between adjacent composite flooring boards. The clips have a T-shaped cross section with a first lip of the clip being secured within the slot of one of the boards and a second lip of the clip being secured within the slot of an adjacent board. By spacing the clips along the length of each board and along both sides of each board, the composite boards can be securely held to the floor joists by the clips without passing any fasteners down through the composite flooring boards. One example of such clips is disclosed in US Patent Publication No. 2006/0059822. Although the clips are useful in avoiding having to place fasteners down through the flooring boards, they do not resolve the above discussed problems of requiring dual joists at each location where the composite flooring boards are disposed end to end.

Accordingly, what is needed in the art are apparatus and methods that solve the above problem of requiring that dual joists be located side by side at each location where flooring boards are being secured end to end. In addition, what is needed in the art are apparatus and methods that help solve all or some of the above other problems associated with mounting flooring boards or other problems known in the art.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
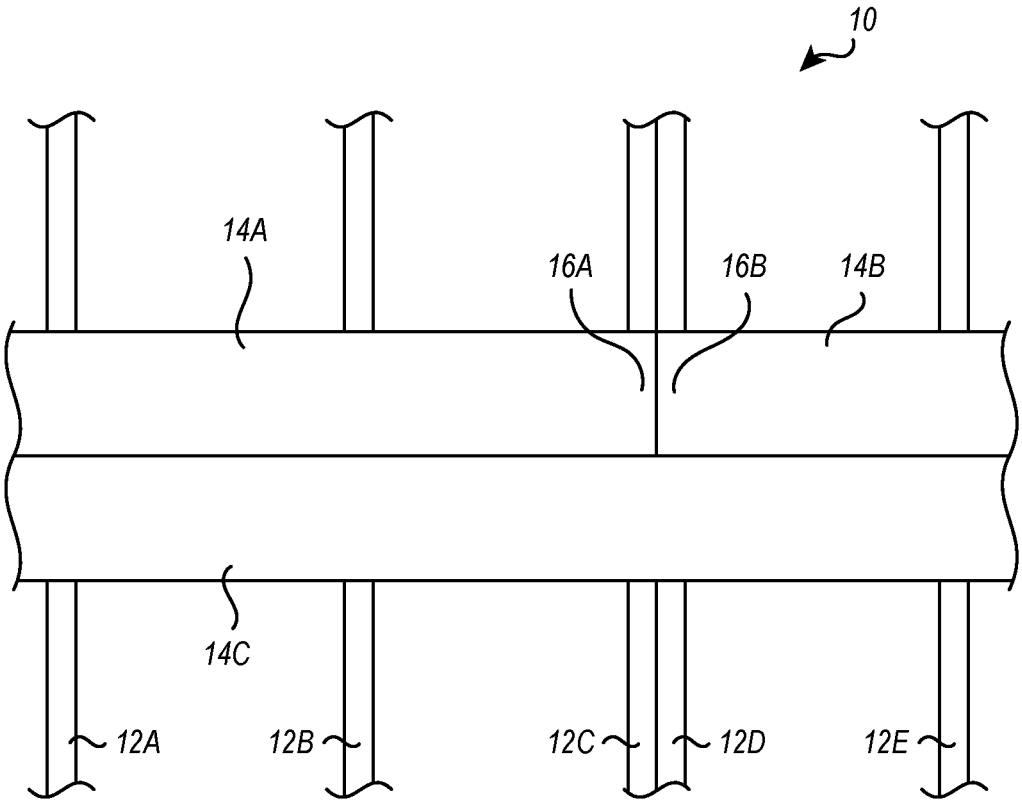
FIG. 1 PRIOR ART
FIG. 1 is a top plan view of a conventional deck flooring system.
Figure 2:
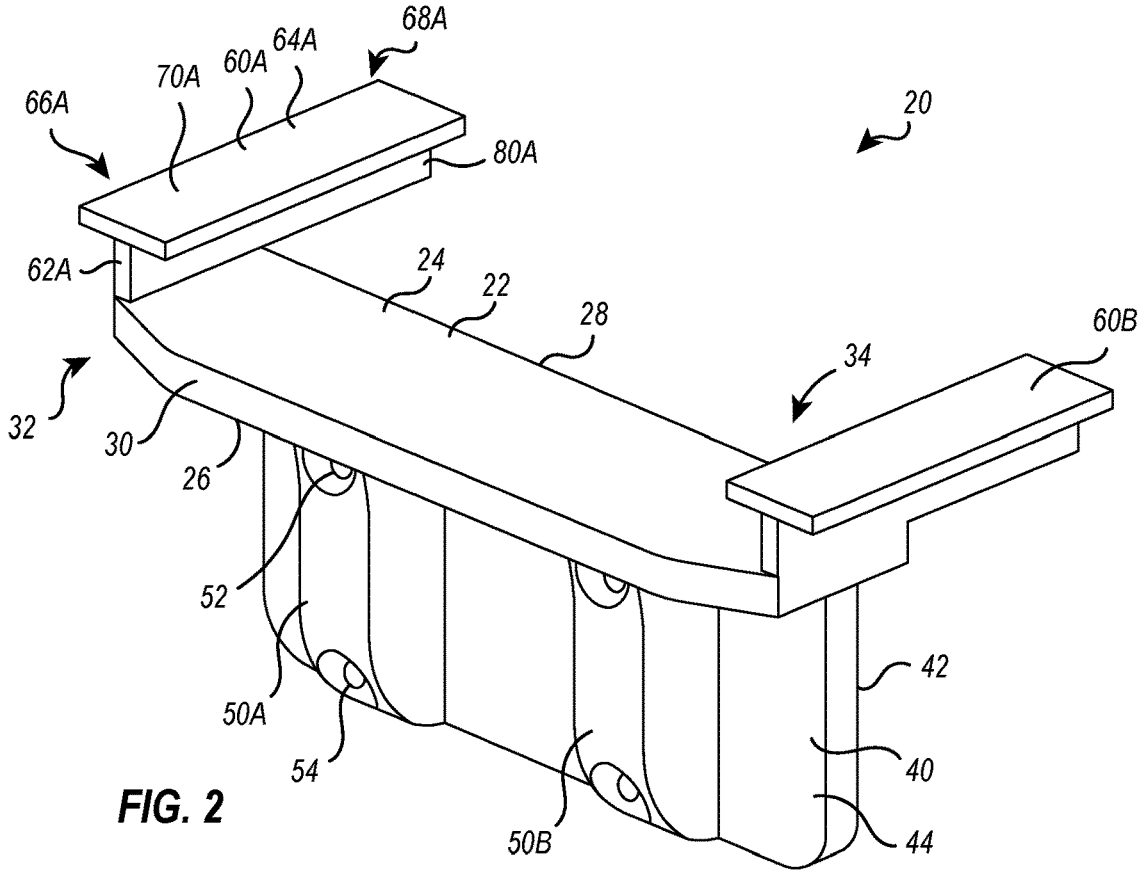
FIG. 2 is a rear perspective view of an inventive flooring bracket.

Before describing the present disclosure in detail, it is to be understood that this disclosure is not limited to particularly exemplified apparatus, systems, assemblies, methods, or process parameters that may, of course, vary. It is also to be understood that the terminology used herein is only for the purpose of describing particular exemplary embodiments of the present disclosure and is not intended to limit the scope of the disclosure in any manner.

The term "comprising" which is synonymous with "including," "containing," or "characterized by," is inclusive or open-ended and does not exclude additional, unrecited elements or method steps.

It will be noted that, as used in this specification and the appended claims, the singular forms "a," "an" and "the" include plural referents unless the content clearly dictates otherwise. Thus, for example, reference to a "connector" includes one, two, or more connectors.

As used in the specification and appended claims, directional terms, such as "top," "bottom," "left," "right," "up," "down," "upper," "lower," "proximal," "distal" and the like are used herein solely to indicate relative directions and are not otherwise intended to limit the scope of the disclosure or claims.

Where possible, like numbering of elements have been used in various figures. Furthermore, multiple instances of an element and or sub-elements of a parent element may each include separate letters appended to the element number. For example, two instances of a particular element "10" may be labeled as "10A" and "10B". In that case, the element label may be used without an appended letter (e.g., "10") to generally refer to all instances of the element or any one of the elements. Element labels including an appended letter (e.g., "10A") can be used to refer to a specific instance of the element or to distinguish or draw attention to multiple uses of the element. Furthermore, an element label with an appended letter can be used to designate an alternative design, structure, function, implementation, and/or embodiment of an element. For example, two alternative exemplary embodiments of a particular element may be labeled as "10A" and "10B". In that case, the element label may be used without an appended letter (e.g., "10") to generally refer to all instances of the alternative embodiments or any one of the alternative embodiments.

Various aspects of the present devices and assemblies may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present. Furthermore, as used herein, the terms "connection," "connected," and the like do not necessarily imply direct contact between the two or more elements.

Various aspects of the present devices, assemblies, and methods may be illustrated with reference to one or more exemplary embodiments. As used herein, the terms "embodiment," "alternative embodiment" and "exemplary embodiment" mean "serving as an example, instance, or illustration," and should not necessarily be construed as required or as preferred or advantageous over other embodiments disclosed herein.

Unless defined otherwise, all technical and scientific terms used herein have the same meaning as commonly understood by one of ordinary skill in the art to which the present disclosure pertains. Although a number of methods and materials similar or equivalent to those described herein can be used in the practice of the present disclosure, the preferred materials and methods are described herein.

Depicted in FIGS. 2-5 is one embodiment of a bracket 20 for interconnecting the terminal ends of boards. More specifically, bracket 20 can be used for interconnecting the terminal end of deck flooring boards and, particularly, composite deck flooring boards.

Bracket 20 comprises a shelf member 22 having a top face 24 and an opposing bottom face 26 that each extend laterally between a front edge 28 and an opposing back edge 30 and that each longitudinally extend between a first end 32 and an opposing second end 34. Top face 24 or at least a portion thereof is typically planar. However, one or more recesses could be formed thereon without significantly altering the functionality thereof. In one embodiment, shelf member 22/top face 24 has a width extending between front edge 28 and back edge 30 that is at least or less than 1, 2, 3, 4, 6, 8, or 10 cm or is in a range between any two of the foregoing values. Other dimensions can also be used. As will be discussed below in more detail, the width is selected to be a size that will adequately support the terminal end of a flooring board that will rest on top face 24. In one embodiment, shelf member 22/top face 24 has a length extending between a terminal end 36 at first end 32 and a terminal end 38 at second end 34 that is at least or less than 6, 8, 10, 12, 14, 16, 18, 20, 25, 30 or 40 cm or is in a range between any two of the foregoing values. Other dimensions can also be used. As will also be discussed below in more detail, the length of shelf member 22/top face 24 can vary depending upon the size of flooring board that bracket 20 is being used with. Shelf member 22 also has a thickness extending between top face 24 and bottom face 26 that is at least or less than 0.5, 1, 2, 3, 4, 5, 6 or 8 mm or is in a range between any two of the foregoing values. Other dimensions can also be used. The thickness of shelf member 22 is dependent upon the material that bracket 20 is made of and is selected so that shelf member 22 has adequate strength and rigidity to freely support the terminal end of a deck flooring board during use. For example, the thickness may be thinner where bracket 20/shelf member 22 is formed from a stronger material, such as a metal, and thicker where made of a weaker material, such as a plastic.

Bracket 20 also comprises a mounting plate 40 having a front face 42 and an opposing back face 44 that each extend between an upper end 46 and an opposing lower end 48. Mounting plate 40 outwardly projects from bottom face 26 of shelf member 22. More specifically, upper end 46 of mounting plate 40 outwardly projects from bottom face 26 of shelf member 22 at or adjacent to front edge 28. As will be discussed below, front face 42 is configured to sit directly against and be secured to the face of a flooring joist. As such, front face 42, or at least a portion thereof, is typically planar. However, one or more recesses could be formed thereon without significantly altering the functionality thereof.

Mounting plate 40, or at least a portion thereof, typically projects orthogonal to shelf member 20. More specifically, front face 42 of the mounting plate 40 can be disposed orthogonal to top face 24 of shelf member 22. Thus, top face 24 of shelf member 22 can be disposed in a plane and front face 42 of mounting plate 40 can be disposed is a plane where the planes are orthogonal to each other. In the above configuration, shelf member 22 projects rearward of back face 44 of mounting plate 40. In one embodiment, shelf member 22 projects rearward of back face 44 by a distance of at least or less than 1, 2, 3, 4, 6, 8, or 10 cm or in a range between any two of the foregoing values. Other dimensions can also be used.

In one embodiment, back face 44 of mounting plate 40 can also be planar. However, because back face 44 does not rest against a surface during use, back face 44 can also have other configurations. Mounting plate 40 can have a thickness extending between front face 42 and back face 44 in the same values as discussed above with regard to the thickness of shelf member 22. Mounting plate 40 typically has a height extending between upper end 46 and lower end 48 that is at least or less than 3, 4, 5, 6, 8, 10, 12 cm or is in a range between any two of the foregoing values. Other dimensions can also be used. In part, the height is sized to receive spaced apart fasteners for securing bracket 20 to a floor joist, as discussed below.

Figure 3:
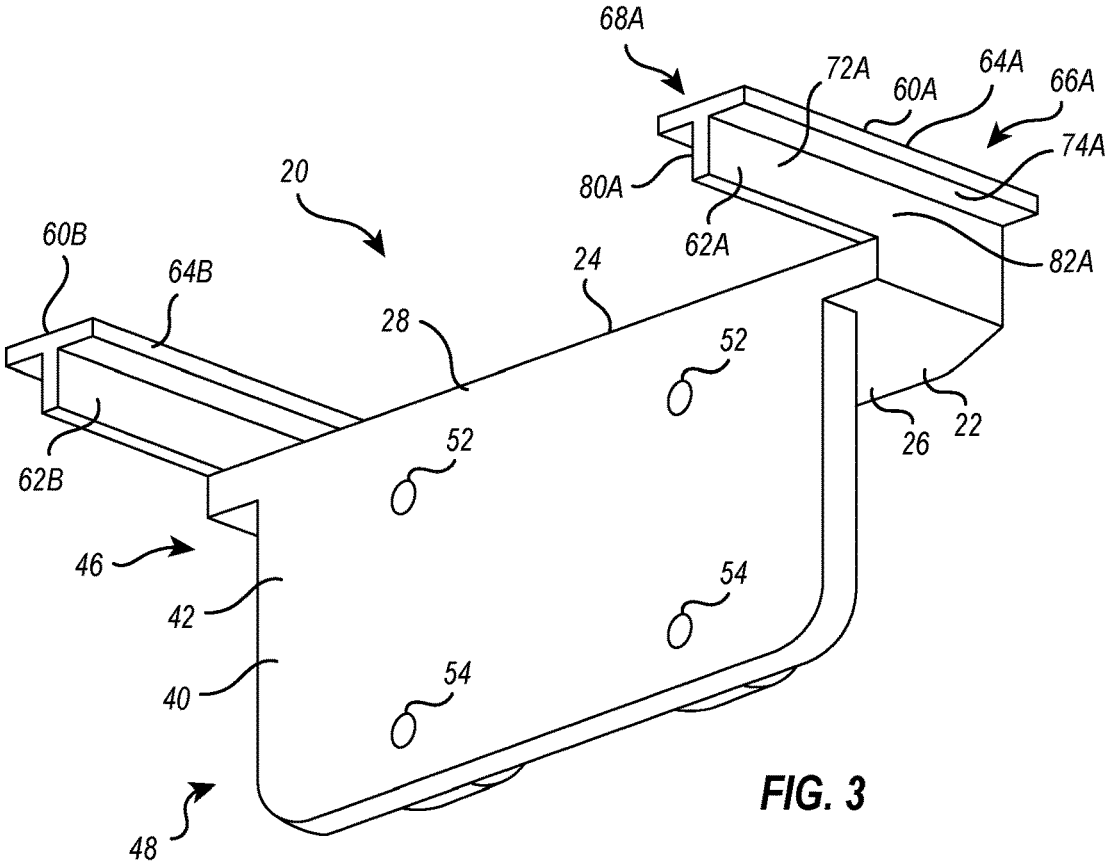
FIG. 3 is a front perspective view of the bracket shown in FIG. 2.
Figure 6:
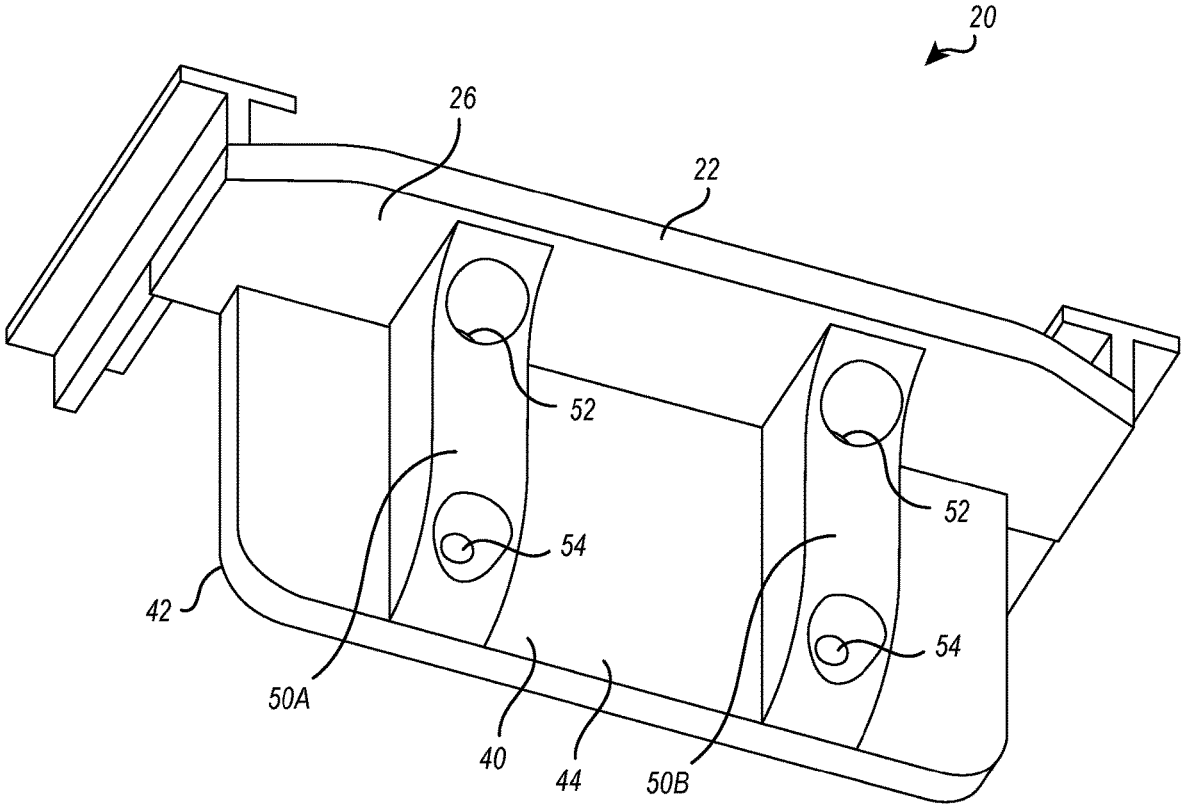
FIG. 6 is a bottom perspective view of the bracket shown in FIG. 2.

As depicted in FIG. 6, in one embodiment, a first brace 50A and a spaced apart second brace 50B are each shown extending between and outwardly projecting from back face 44 of the mounting plate 40 and bottom face 26 of shelf member 22. Braces 50A and 50B function to structurally reinforce shelf member 22 to help prevent failure or unwanted flexing of shelf member 22 when shelf member 22 is supporting the end of a flooring board during use, as discussed below. Each brace 50A and 50B is also shown having a first hole 52 and a longitudinally spaced apart second hole 54 passing therethrough. First hole 52 and second hole 54 also continue on and pass through mounting plate 40 from back face 44 to front face 42 (FIG. 3). Holes 52 and 54 are used for receiving fasteners, such as screws, nails, bolts, pins, or the like, that secure bracket 20 and, more particularly, front face 42 of mounting plate 40, against a floor joist or other support structure. In this configuration, braces 50A and 50B also function to reinforce mounting plate 40 for carrying the load transferred through the fasteners during use of bracket 20.

It is appreciated that braces 50A and 50B can have a variety of different configurations and that alternative numbers of braces can be used. For example, in the depicted embodiment, two braces 50A and 50B are shown to try and optimize the reinforcing properties while minimizing material cost. However, in alternative embodiments a single enlarged brace can be used having four holes or other number of holes passing therethrough. In yet other embodiments, particularly where larger brackets are used for supporting larger flooring boards, three, four, five or more spaced apart braces 50 can be formed outwardly projecting from and extending between back face 44 of mounting plate 40 and bottom face 26 of shelf member 22. Each brace 50 can have one, two, or three or more holes extending therethrough to receive a fastener. In still other embodiments, braces 50 can be eliminated by either forming shelf member 22 and mounting plate 40 out of a high strength material, such as a metal like steel or aluminum, or, alternatively, by increasing the thickness of shelf member 20 and/or mounting plate 40.

Returning to FIGS. 1-4, bracket 20 also includes a first connector 60A upstanding from the top face 24 of shelf member 22 at first end 32 thereof and projecting forward of front face 42 of mounting plate 40. First connector 60A, or at least a portion thereof, can have a T-shaped transverse cross section. First connector 60A has a first end 66A disposed on top face 24 of shelf member 22 at first end 32 thereof and an opposing second end 68A that is freely suspended forward of front face 42 of mounting plate 40. First connector 60A projects orthogonal to front face 42 of mounting plate 40. First connector 60A also has a top surface 70A that is typically planar and is disposed parallel to top face 24 of shelf member 22 and/or perpendicular to front face 42 of mounting plate 40. First connector 60A typically has a length extending between first end 66A and second end 68A that is at least or less than 3, 4, 5, 6, 8, 10 cm or is in a range between any two of the foregoing. Other dimensions can also be used. In addition, first connector 60A typically projects forward of front face 42 of mounting plate 40 by a distance of at least or less than 1, 2, 3, 4, or 6 cm or is in a range between any two of the foregoing. Other dimensions can also be used.

Figure 4:
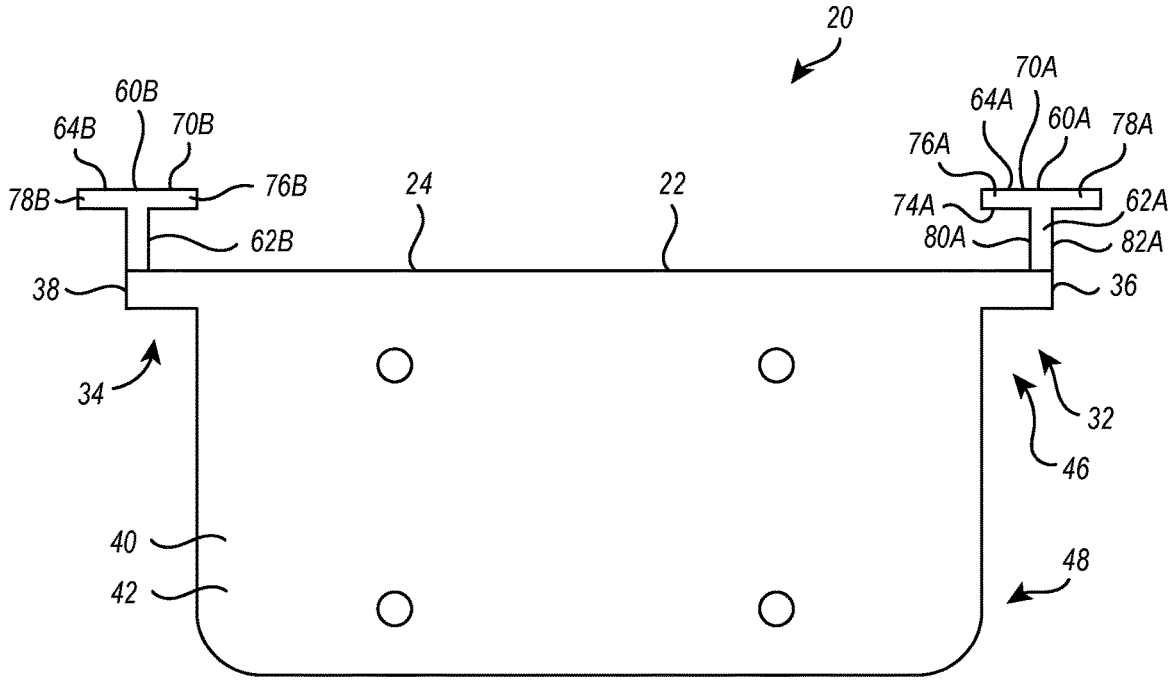
FIG. 4 is front elevational view of the bracket shown in FIG. 2.
Figure 5:
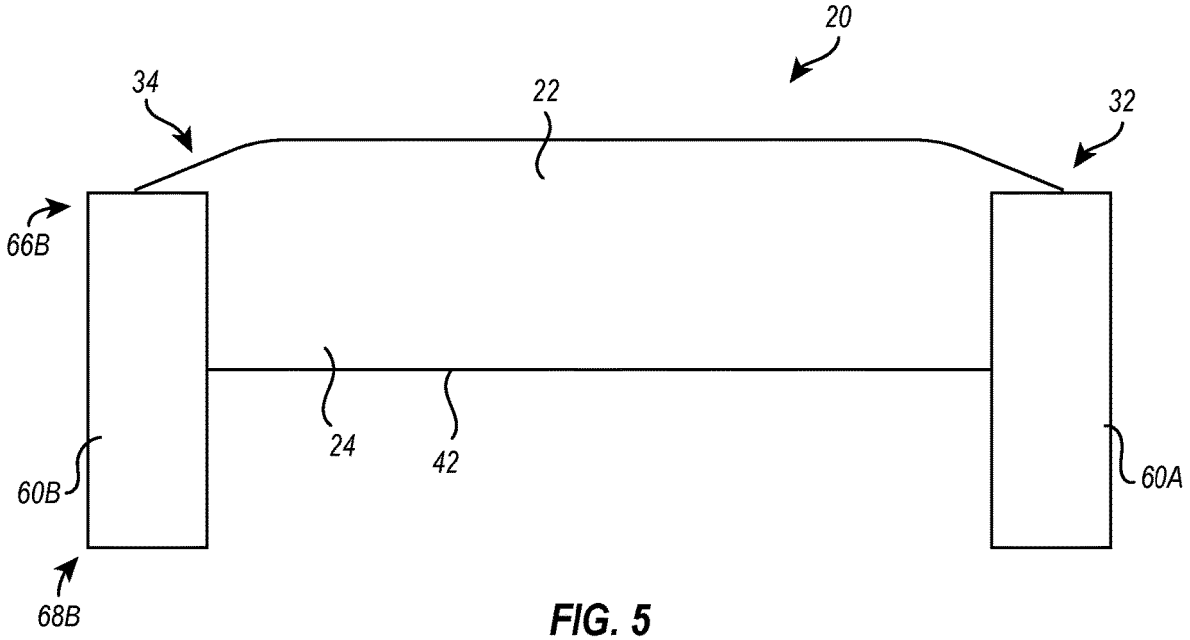
FIG. 5 is a top plan view of the bracket shown in FIG. 2.

More specifically, first connector 60A comprises a riser 62A upstanding from top face 24 of shelf member 22 at first end 32 thereof. Riser 62A has an upstanding interior side 80A and opposing exterior side 82A that extend between first end 66A and second end 68A. In one embodiment, riser 62A is in the form of an elongated plate and can have a rectangular configuration. A flange 64A is disposed at an upper end 72A of riser 62A and extends along riser 62A between first end 66A and second end 68A. Flange 64A outwardly projects from riser 62A. As best depicted in FIG. 4, in one embodiment, riser 62A and flange 64A combine to form the T-shaped transverse cross section. Flange 64A can also be in the form of an elongated plate having top surface 70A and an opposing bottom surface 74A. Flange 64A can be positioned so that riser 62A extends centrally along bottom surface 74A of flange 64A. Flange 64A thus forms an elongated inside arm 76A that outwardly projects over interior side 80A of riser 62A and an elongated outside arm 78A that outwardly projects over opposing exterior side 82A of riser 62A. Flange 64A and each of first arm 76A and second arm 78A can each project orthogonal to riser 62A.

Riser 62A has a thickness extending between interior side 80A and exterior side 82A that is typically in a range between 1 mm and 8 mm with between 1 mm and 5 mm and between 1 mm and 3 mm being more common. Riser 62A needs to be sufficiently thick to have desired strength properties but cannot be too thick as it typically fits at least partially between adjacent flooring boards, as discussed below. Furthermore, flange 64A has a thickness between top surface 70A and bottom surface 74A that is typically in a range between 1 mm and 8 mm with between 1 mm and 5 mm and between 1 mm and 3 mm being more common. Flange 64A needs to be sufficiently thick to have desired strength properties but cannot be too thick as it typically fits within a slot formed on the flooring boards, as discussed below.

Bracket 20 also includes a second connector 60B upstanding from the top face 24 of shelf member 22 at second end 34 thereof and projecting forward of front face 42 of mounting plate 40. Second connector 60B has the same configuration, dimensions, alternatives, and structural elements as first connector 60A. Second connector 60B also has the same positioning as first connector 60A except that second connector 60B is located at second end 34 of shelf member 22 as opposed to first end 32. All of the above disclosure and alternatives discussed herein with regard to first connector 60A is also applicable to second connector 60B and all like elements between first connector 60A and second connector 60B are identified by like reference characters except that the reference characters for second connector 60B include the suffix "B" rather than "A". For Example, second connector 60B, or at least a portion thereof, can have a T-shaped transverse cross section. Second connector 60B has a first end 66B disposed on top face 24 of shelf member 22 at second end 34 thereof and an opposing second end 68B that is freely suspended forward of front face 42 of mounting plate 40. Second connector 60B projects orthogonal to front face 42 of mounting plate 40. Second connector 60B also has a top surface 70B that is typically planar and is disposed parallel to top face 24 of shelf member 22 and/or perpendicular to front face 42 of mounting plate 40. Second connector 60B can also include riser 62B and flange 64B where flange 64B includes inside arm 76B and outside arm 78A. Top face 70A of first connector 60A can be disposed in the same plane as top face 70B of second connector 60B while first connector 60A can be disposed in parallel alignment with second connector 60B.

In one embodiment, bracket 20 and all of the components thereof can be formed from a plastic, fiberglass, composite, reinforced cement, metal, such as steel or aluminum, or other materials having desired properties. Molding bracket 20 from a plastic, such as by injection molding, has been found beneficial in that bracket 20 can be produced quickly and inexpensively while still having desired strength properties. All of the components of bracket 20 are typically made from the same material. In one embodiment, bracket 20 including shelf member 22, mounting plate 40, first connector 60A, and second connector 60B are integrally formed as a single unitary member, as opposed to separate components that are separately connected together. Braces 50 can also be integrally formed therewith. For example, bracket 20 can be formed by molding, casting, folding, 3D printing or other conventional techniques.

Figure 7:
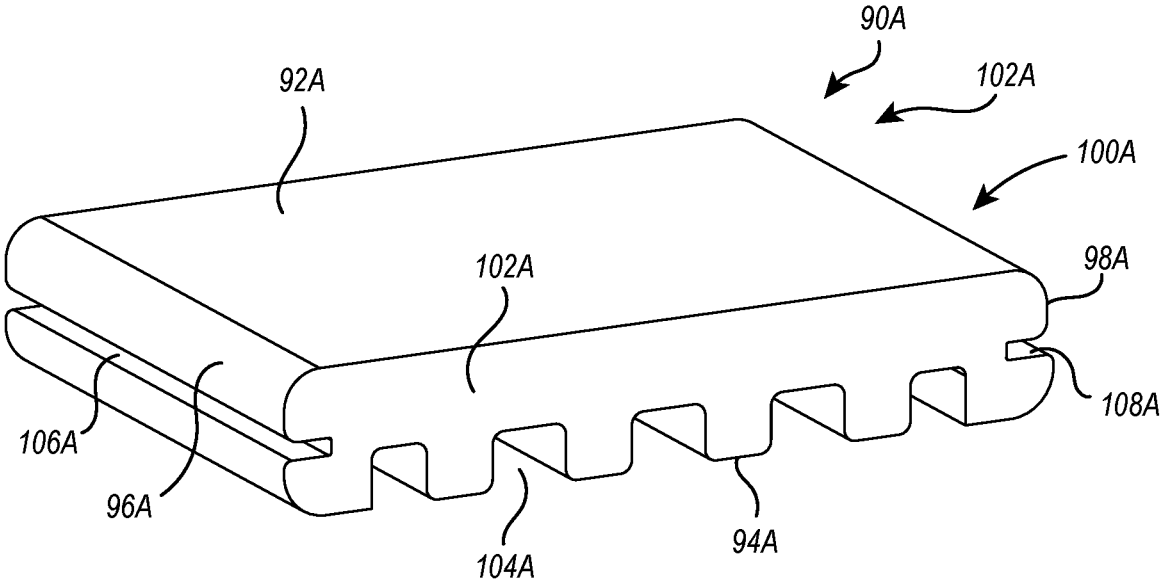
FIG. 7 is perspective view of a flooring board for use with the bracket shown in FIG. 2.

Depicted in FIG. 7 is one example of a flooring board 90A that can be used in association with bracket 20 for forming a floor, such as a deck. Flooring board 90A has a top surface 92A and an opposing bottom surface 94A that laterally extend between a first side surface 96A and an opposing second side surface 98A and that longitudinal extend between a first end 100A and an opposing second end 102A. Top surface 92A is typically planar or substantially planar although any desired texture, pattern, or finish can be formed thereon. Bottom surface 94A is shown having a plurality of laterally spaced apart channels 104A recessed therein that longitudinally extend between first end 100A and second end 102A. In alternative embodiments, channels 104A can be eliminated and bottom surface 94A can be planar or substantially planar, the same as top surface 92A, and be disposed parallel to top surface 92A. Recessed into first side surface 96A is a first slot 106A and recessed into second side surface 98A is a second slot 108A. First slot 106A and second slot 108A longitudinally extend between first end 100A and second end 102A. In addition, first slot 106A and second slot 108A each typically have the same configuration and are disposed in a common plane that is typically parallel to top surface 92A. As discussed below, first slot 106A is configured to receive flange 64A/inside arm 76A of first connector 60A while second slot 108A is configured to receive flange 64B/inside arm 76B of second connector 60B.

Flooring board 90A can be formed having a variety of different thicknesses extending between top surface 92A and bottom surface 94A, widths extending between opposing side surfaces 96A and 98B, and lengths extending between first end 100A and second end 102A. However, flooring boards are typically formed in a limited number of standard dimensions. Flooring board 90A can be a composite board produced from a blend of wood and plastic particles that are formed into a board shape, as discussed in the background section. Composite flooring boards are available from Fiberon Composites of New London, N.C., and the Trex Corporation of Winchester, Va. and are sold under the trademark TREX. Alternatively, flooring board 90A can be comprised of wood, plastic, metal, concrete, other composite materials or other materials.

Figure 8:
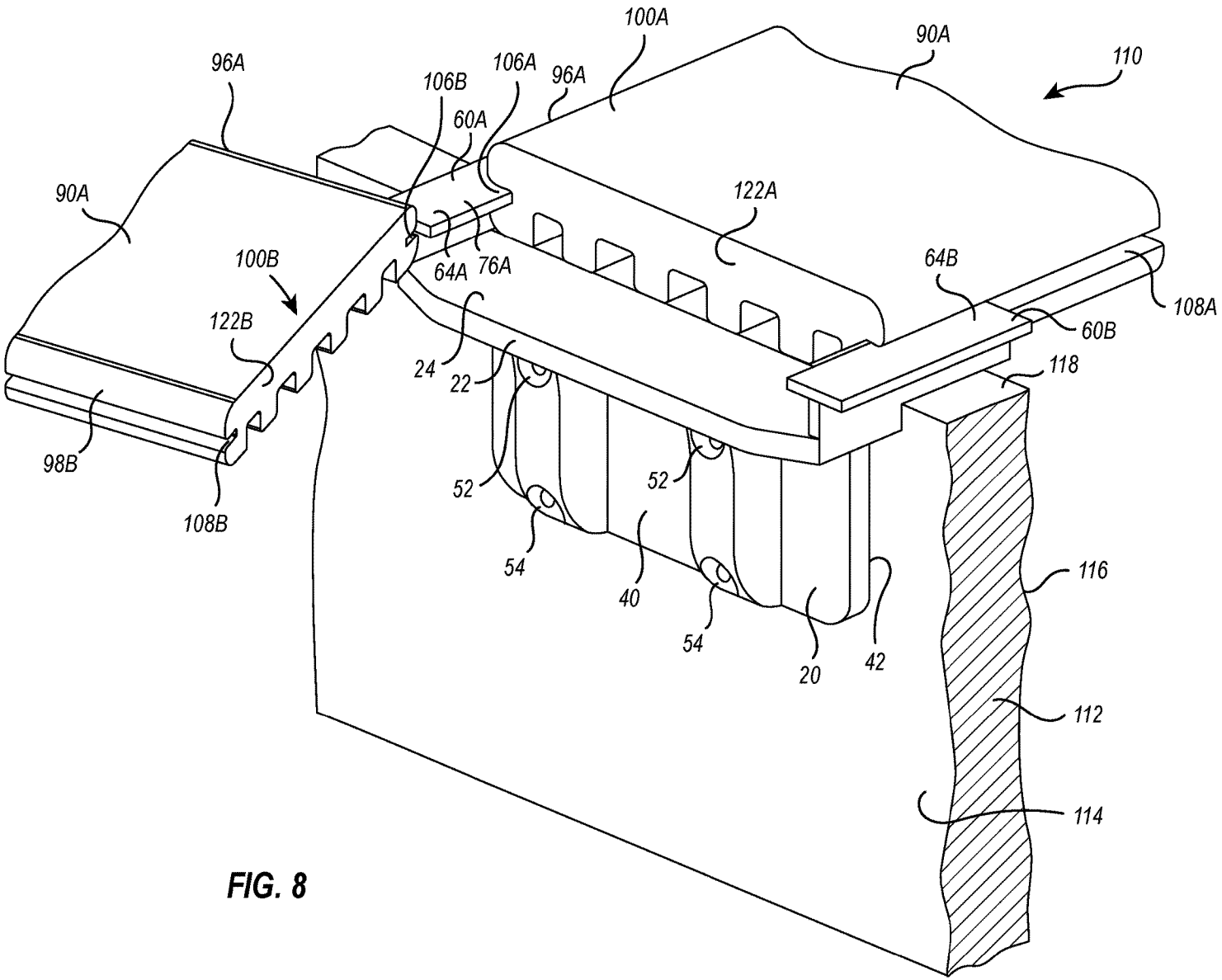
FIG. 8 is perspective view of the bracket shown in FIG. 2 mounted on a flooring joist and coupled with a first flooring board.

As previously discussed, bracket 20 can be used for interconnecting the terminal end of deck flooring boards. For example, depicted in FIG. 8 is a flooring assembly 110 comprising a floor joist 112, flooring board 90A, and a flooring board 90B. Flooring board 90B has the same configuration and elements as flooring board 90A and can be made of the same materials and have the same alternatives as flooring board 90A. As such, like elements between flooring board 90A and flooring board 90B are identified by like reference numbers except that the reference numbers for flooring board 90B include the suffix "B" rather than "A".

Floor joist 112 has a first face 114 and an opposing second face 116, which are typically vertically disposed when in use, and an upwardly facing side edge 118 extending therebetween. Floor joist 112 is typically made of wood but can also be comprised of metal, concrete, composite, laminated, or other material. Bracket 20 is mounted on first face 114 of floor joist 112 by positioning front face 42 of mounting plate 40 against first face 114 of floor joist 112 so that top face 24 of shelf member 22 is flush with side edge 118 of floor joist 112, as shown in FIG. 8. Bracket 20 is then secured in place by advancing fasteners into each of holes 52 and 54 so that fasteners pass thought mounting plate 40 and into floor joist 112, thereby securing bracket 20 to floor joist 112. Either prior to securing bracket 20 to floor joist 112 or after securing bracket 20 to floor joist 112, first end 100A of flooring board 90A is slid between second end 68A of first connector 60A and second end 68B of second connector 60B of bracket 20 so that bracket 20 and flooring board 90 are secured together. Specifically, bracket 20 used in flooring assembly 110 is selected so as to be specifically sized so that as first end 100A of flooring board 90A is slid between first connector 60A and second connector 60B, flange 64A/inside arm 76A of first connector 60A is slid into first slot 106A of flooring board 90A and flange 64B/inside arm 76B of second connector 60B is received within second slot 108A of flooring board 90A. This engagement between flooring board 90A and connectors 60A and 60B prevents vertical separation between flooring board 90A and bracket 20 when flooring board 90A is horizontally disposed.

First end 100A of flooring board 90A terminates at a terminal end face 122A. Terminal end face 122A can be a natural end of flooring board 90A or a cut end where flooring board 90A is cut to a desired length. In either event, flooring board 90A is sized so that when assembled into flooring assembly 110 by passing first end 100A between connectors 60A and 60B, as discussed above, first end 100A is resting on top of side edge 118 of floor joist 112. More commonly, flooring board 90A is sized/positioned so that terminal end face 122A is disposed flush with or adjacent to first face 114 of floor joist 112 while first end 100A is resting on top of side edge 118 of floor joist 112. Floor joist 112 provides vertical support to first end 100A of flooring board 90A so as to prevent unwanted downward flexing or movement of first end 100A when a load is applied on top of first end 100A. However, first end 100A of flooring board 90A can still slid longitudinally relative to bracket 20/connectors 60A and 60B to accommodate for expansion or contraction caused by changes in temperature.

Figure 9:
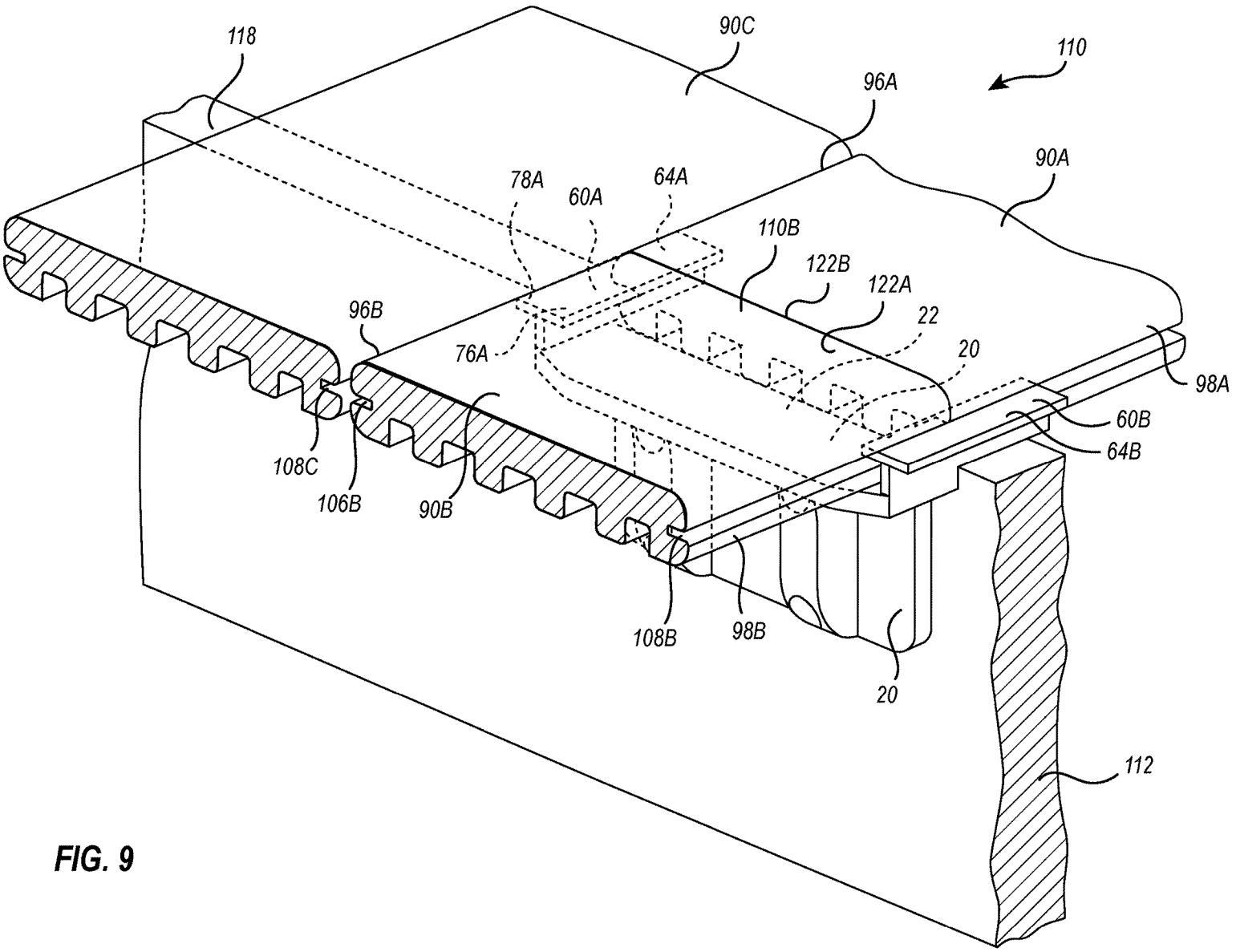
FIG. 9 is perspective view of the assembly shown in FIG. 8 having a second flooring board coupled with the bracket.

With reference to FIGS. 8 and 9, as with flooring board 90A, flooring board 90B has a first end 100B that terminates at a terminal end face 122B. Flooring board 90B also includes slots 106B and 108B formed on first side surface 96B and second side surface 98B, respectively. After bracket 20 is secured to floor joist 112, as discussed above, first end 100B of flooring board 90B is slid between first end 66A of first connector 60A and first end 66B of second connector 60B of bracket 20 so that bracket 20 and flooring board 90B are secured together and so that first end 100B is disposed on top face 24 of shelf member 22 of bracket 20. Specifically, bracket 20 is selected so as to be specifically sized so that as first end 100B of flooring board 90B is slid between first connector 60A and second connector 60B, flange 64A/inside arm 76A of first connector 60A is slid into first slot 106B of flooring board 90B and flange 64B/inside arm 76B of second connector 60B is received within second slot 108B of flooring board 90B. Again, this engagement between flooring board 90B and connectors 60A and 60B prevents vertical separation between flooring board 90B and bracket 20. In addition, as first end 100B is slid between connectors 60A and 60B, first end 100B is slid on top of shelf member 22. Shelf member 22 provides vertical support to first end 100B of flooring board 90B so as to prevent unwanted downward flexing, twisting or movement of first end 100B when a load is applied on top of first end 100B.

Connectors 60A and 60B prevent unwanted lifting and/or lateral movement of first end 100B. However, first end 100B of flooring board 90B can still slid longitudinally relative to bracket 20/connectors 60A and 60B to accommodate for expansion or contraction caused by changes in temperature. During assembly, first end 100B is typically advanced between connectors 60A and 60B until terminal end face 122B is disposed against or adjacent to terminal end face 122A of flooring board 90A. The remainder of flooring board 90B is then secured to other spaced apart joists as is known in the art. Accordingly, by using bracket 20, the terminal ends of flooring boards 90A and 90B can be secured adjacent to each other end to end so that they are both vertically and laterally supported through the use of a single floor joist 112. That is, by using bracket 20, no second floor joist is disposed or required against or adjacent to either face 114 or 116 of floor joist 112.

It is appreciated that the above sequence of the method steps can be altered into any desired order. For example, in one alternative, flooring board 90B could be secured to bracket 20 prior to flooring board 90A being secured to bracket 20. In another alternative, both or either one of flooring board 90A and 90B can be secured to bracket 20 before bracket 20 is secured to floor joist 112. Other alternatives also exist.

During the further assembly of flooring assembly 110, further flooring boards can be disposed on opposing sides of bracket 20 and secured to bracket 20. For example, a flooring board 90C, having the same configuration and structural elements as flooring board 90A, can be disposed so as to extend along side surface 96A of flooring board 90A and along side surface 96B of flooring board 90B. Flange 60A/outside arm 78A of first connector 60A is received within slot 108C of flooring board 90C so as to help secure flooring board 90C to floor joist 112. Likewise, a further flooring board can be placed along side surface 98A of flooring board 90A and along side surface 98B of flooring board 90B so as to receive flange 60B/outside arm 78B within a side slot of the further flooring board.

Bracket 20 can achieve one or more of a number of unique advantages. For example, by using bracket 20, only a single floor joist is required for properly interconnecting and supporting the terminal end of two flooring boards. As such, the use of brackets 20 eliminates the time, cost and labor associated with the purchase and installation of second flooring joists at each location where flooring boards are being secured together end-to-end. Brackets 20 are easy and inexpensive to produce. As such, significant savings are achieved in time, cost and labor by replacing a floor joist with multiple brackets 20. In addition, brackets 20 eliminate the need for having to drive fasteners down through the ends of flooring boards for securing them to floor joists. As such, brackets 20 eliminate damage and scarring caused by conventional fasteners. Brackets 20 also help eliminate unwanted movement or loosening of flooring boards which is common with flooring board secured by conventional fasteners. However, in some embodiments, the ends of the flooring boards can freely slide relative to the brackets when expanding or contracting as a result in changes of temperature, thereby avoiding unnecessary loads on fasteners typically used to secure the ends of the flooring boards. A further advantage of brackets 20 is that flooring boards can be easily removed from brackets 20 without damage to the flooring boards or brackets 20. Brackets 20 also help facilitate easy replacement of flooring boards. Additional benefits of brackets 20 are that they are substantially hidden from view during use and are easy to mount and attach to flooring boards and floor joists. Other advantages also exist.

Figure 10:
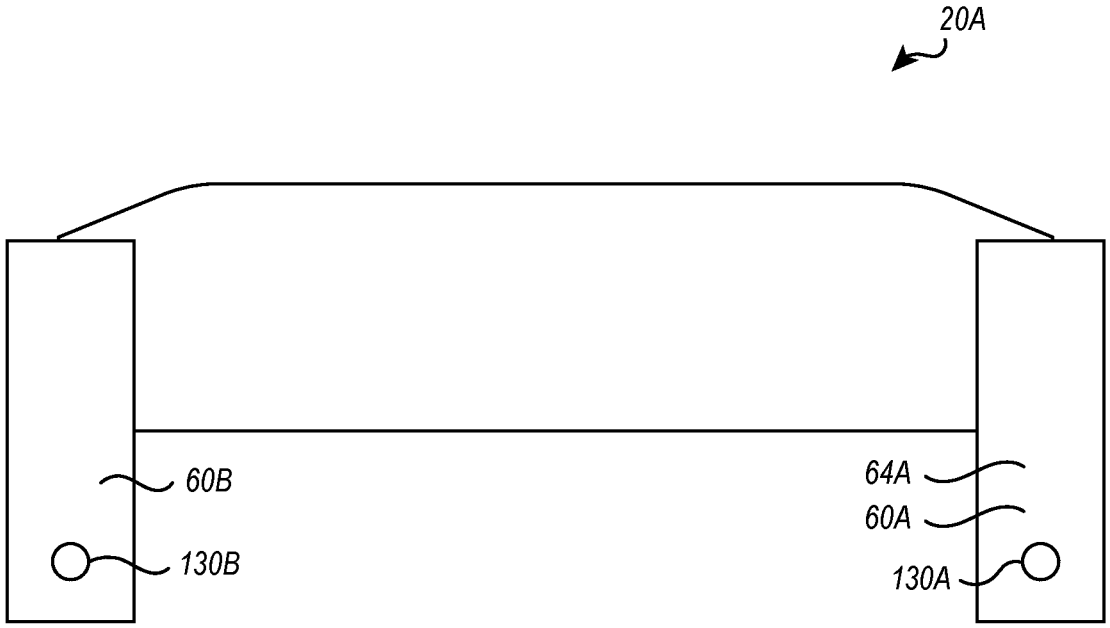
FIG. 10 is top plan view of an alternative embodiment of the bracket shown in FIG. 5.

It is also appreciated that bracket 20 can be formed having a variety of alternative configurations. For example, depicted in FIG. 10 is a top plan view of bracket 20A. Like elements between brackets 20 and 20A are identified by like reference numbers. Brackets 20 and 20A have identical configurations except that bracket 20A includes a hole 130A formed on first connector 60A and a hole 130B formed on second connector 60B. More specifically, hole 130A passes through flange 64A and riser 62A (FIG. 3) at second end 68A of first connector 60A while hole 130B passes through flange 64B and riser 62B (FIG. 3) at second end 68B of second connector 60B. During use, fasteners, such as screws, bolts, pins, nails or the like, can be passed through holes 130A and 130B and secure into floor joist 112 so as to reinforce connectors 60A and 60B and further stabilize the flooring boards. In another alternative, two or more holes 130A and 130B can be formed in each of connectors 60A and 60B. In another alternative, one or both of outside arms 78A and 78B of connectors 60A and 60B can be eliminated, such as when no flooring board will be placed next to bracket 20. In this embodiment, one or both of connectors 60A and 60B will have an L-shaped configuration. Other modifications can also be made.

Furthermore, although bracket 20, as disclosed above, is primary designed for the securing of the ends of flooring boards, such as in forming a deck, it is also envisioned that brackets 20 could be formed on a much larger scale and from higher strength materials, such as steel and/or concrete for use in supporting the ends of support decks, suspended roads, trusses, bridge decks, slabs, and the like.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, processes, and/or products according to certain embodiments of the present disclosure may include, incorporate, or otherwise comprise properties features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative assemblies, processes, products, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A bracket comprising:

a shelf member having a top face and an opposing bottom face that each extend between a front edge and an opposing back edge and that each extend between a first end and an opposing second end;

a mounting plate having a front face and an opposing back face that each extend between an upper end and an opposing lower end, the upper end of the mounting plate projecting outward from the bottom face of the shelf member so that the shelf member projects rearward of the back face of the mounting plate;

a first connector upstanding from the top face of the shelf member at the first end thereof and projecting forward of the front face of the mounting plate, the first connector having a T-shaped transverse cross section; and a second connector upstanding from the top face of the shelf member at the second end thereof and projecting forward of the front face of the mounting plate, the second connector having a T-shaped transverse cross section.

2. The bracket as recited in claim 1, wherein at least a portion of the mounting plate projects orthogonal to the shelf member.

3. The bracket as recited in claim 1, wherein the top face of the shelf member is planer and the front face of the mounting plate is planar, the front face of the mounting plate being disposed orthogonal to the top face of the shelf member.

4. The bracket as recited in claim 1, wherein the mounting plate, the shelf member, the first connector, and the second connector are integrally formed as a single unitary member as opposed to separate members connected together.

5. The bracket as recited in claim 1, wherein the mounting plate, the shelf member, the first connector, and the second connector are each comprised of plastic.

6. The bracket as recited in claim 1, wherein the top face of the shelf member has a length extend between the front edge and the back edge that is greater than 2 cm.

7. The bracket as recited in claim 1, wherein the shelf member is elongated and longitudinally extends between the first end and the second end, the shelf member having a length extending between the first end and the second end that is at least 8 cm.

8. The bracket as recited in claim 1, wherein at least a portion of the first connector freely projects forward of the front face of the mounting plate by a distance of at least 1.5 cm.

9. The bracket as recited in claim 1, wherein the first connector comprises a riser upstanding from the top face of the shelf member and a flange disposed on an upper end of the riser so that the riser and flange have the T-shaped transverse cross section, a top surface of the flange extending continuously between opposing ends of the flange that are disposed on opposing sides of the riser.

10. The bracket as recited in claim 1, further comprising a first brace extending between and outwardly projecting from the back face of the mounting plate and the bottom face of the shelf member.

11. The bracket as recited in claim 1, wherein the bracket is configured for interconnecting terminal ends of flooring boards.

12. A method for interconnecting ends of boards used in flooring, the method comprising:

securing a mounting plate of a bracket to a first side of a first floor joist so that a top surface of a shelf member of the bracket that extends from the mounting plate is flush with a top edge of the first floor joist and the shelf member does not overlay the top edge of the first floor joist, the bracket having a first connector and a spaced apart second connector upstanding from the top surface of the shelf member;

either before or after securing the mounting plate to the first floor joist, sliding an end of a first board between the first connector and the second connector so that the end of the first board overlies the top edge of the first floor joist, a portion of the first connector being received within a first slot formed on the first board and a portion of the second connector being received within a second slot formed on the first board so that the first connector and the second connector secure the first board to the bracket; and either before or after securing the mounting plate to the first floor joist, sliding an end of a second board between the first connector and the second connector so that the end of the second board rests on the top surface of the shelf member, a portion of the first connector being received within a first slot formed on the second board and a portion of the second connector being received within a second slot formed on the second board so that the first connector and the second connector secure the second board to the bracket.

13. The method as recited in claim 12, wherein the first connector and the second connector each have a T-shaped transverse cross section.

14. The method as recited in claim 12, wherein a second side of the first floor joist that is opposite of the mounting plate is freely exposed with no second floor joist being disposed there against.

15. The method as recited in claim 12, wherein a terminal end of the first board and a terminal end of the second board are each disposed between the first connector and the second connector.

16. The method as recited in claim 12, further comprising positioning a third board along a portion of a length of the first board and the second board so that the third board is resting on the top edge of the first floor joist, a portion of the first connector being received within a first slot formed on the third board so as to help secure the third board to the first floor joist.

17. The method as recited in claim 12, wherein the first board has a top surface and an opposing bottom surface that each extend between a first side edge and an opposing second side edge, the first slot of the first board being formed along the first side edge and the second slot of the first board being formed along the second side edge.

18. The method as recited in claim 12, wherein the bracket is configured so that when the mounting plate is secured to the first side of the first floor joist, the shelf member projects rearward of the mounting plate away from the floor joist and at least a portion of the first connector and the second connector project forward of the mounting plate so as to extend over the floor joist.

19. A bracket comprising:

a shelf member having a top face and an opposing bottom face that each extend between a front edge and an opposing back edge and that each extend between a first end and an opposing second end;

a mounting plate having a front face and an opposing back face that each extend between an upper end and an opposing lower end, the upper end of the mounting plate projecting outward from the bottom face of the shelf member;

a first brace extending between and outwardly projecting from the back face of the mounting plate and the bottom face of the shelf member;

a first connector upstanding from the top face of the shelf member at the first end thereof and projecting forward of the front face of the mounting plate, the first connector having a T-shaped transverse cross section; and a second connector upstanding from the top face of the shelf member at the second end thereof and projecting forward of the front face of the mounting plate, the second connector having a T-shaped transverse cross section.

20. The bracket as recited in claim 19, further comprising a first mounting hole passing through first brace and the mounting plate.

21. The bracket as recited in claim 19, wherein the mounting plate, the shelf member, and the first brace are integrally formed as a single unitary member as opposed to separate members connected together.

* * * * *